US008858159B2

(12) United States Patent
Piggush et al.

(10) Patent No.: US 8,858,159 B2
(45) Date of Patent: Oct. 14, 2014

(54) GAS TURBINE ENGINE COMPONENT HAVING WAVY COOLING CHANNELS WITH PEDESTALS

(75) Inventors: Justin D. Piggush, La Crosse, WI (US); Ricardo Trindade, Coventry, CT (US)

(73) Assignee: United Technologies Corporation, Hartford, CT (US)

( * ) Notice: Subject to any disclaimer, the term of this patent is extended or adjusted under 35 U.S.C. 154(b) by 495 days.

(21) Appl. No.: 13/284,471

(22) Filed: Oct. 28, 2011

(65) Prior Publication Data

US 2013/0108416 A1 May 2, 2013

(51) Int. Cl.

| | |
|---|---|
| ***F01D 5/18*** | (2006.01) |
| ***F01D 9/04*** | (2006.01) |
| ***F01D 11/24*** | (2006.01) |
| ***F01D 5/20*** | (2006.01) |

(52) U.S. Cl.

CPC *F01D 5/20* (2013.01); *F01D 11/24* (2013.01); *F05D 2250/231* (2013.01); *F05D 2240/11* (2013.01); *F01D 5/187* (2013.01); *F05D 2260/2212* (2013.01); *F05D 2250/184* (2013.01); *F05D 2260/2214* (2013.01)

USPC ..... 415/115; 415/116; 415/173.1; 416/97 R

(58) Field of Classification Search

USPC ..... 415/115, 173.1; 416/95, 96 R, 97 R

See application file for complete search history.

(56) References Cited

U.S. PATENT DOCUMENTS

| | | | | |
|---|---|---|---|---|
| 4,203,706 | A | 5/1980 | Hess | |
| 4,359,310 | A | 11/1982 | Endres et al. | |
| 4,515,523 | A * | 5/1985 | North et al. | 415/115 |
| 5,328,331 | A * | 7/1994 | Bunker et al. | 416/96 R |
| 5,375,973 | A * | 12/1994 | Sloop et al. | 415/173.1 |
| 5,645,397 | A | 7/1997 | Soechting et al. | |
| 5,704,763 | A | 1/1998 | Lee | |
| 5,738,493 | A | 4/1998 | Lee et al. | |
| 5,931,638 | A | 8/1999 | Krause et al. | |
| 6,152,695 | A * | 11/2000 | Fukue et al. | 416/97 R |
| 6,247,896 | B1 | 6/2001 | Auxier et al. | |
| 6,890,154 | B2 | 5/2005 | Cunha | |
| 6,984,102 | B2 | 1/2006 | Bunker et al. | |
| 7,011,502 | B2 * | 3/2006 | Lee et al. | 416/97 R |
| 7,232,290 | B2 | 6/2007 | Draper et al. | |
| 7,306,424 | B2 * | 12/2007 | Romanov et al. | 415/115 |
| 7,665,962 | B1 * | 2/2010 | Liang | 415/173.1 |
| 7,753,650 | B1 | 7/2010 | Liang | |
| 7,785,070 | B2 | 8/2010 | Liang | |
| 7,819,169 | B2 * | 10/2010 | Pietraszkiewicz et al. | 164/132 |
| 2003/0108422 | A1 | 6/2003 | Merry | |
| 2010/0003142 | A1 | 1/2010 | Piggush et al. | |
| 2010/0098526 | A1 | 4/2010 | Piggush | |
| 2011/0052413 | A1 | 3/2011 | Kwon et al. | |
| 2013/0108416 | A1 * | 5/2013 | Piggush et al. | 415/173.1 |
| 2013/0323033 | A1 * | 12/2013 | Lutjen et al. | 415/173.1 |

* cited by examiner

*Primary Examiner* — Edward Look
*Assistant Examiner* — Christopher R Legendre
(74) *Attorney, Agent, or Firm* — Kinney & Lange, P.A.

(57) ABSTRACT

A gas turbine engine component comprises a plurality of walls, a cooling channel, a plurality of ribs and a plurality of pedestals. The plurality of walls has a pair of major surfaces opposed to define an interior chamber. The cooling channel extends through the interior chamber of the plurality of walls between the major surfaces. The plurality of ribs extends through the cooling channel to form a plurality of wavy passages having bowed-out sections. The plurality of pedestals is positioned between adjacent ribs, each pedestal being positioned in a bowed-out section.

21 Claims, 6 Drawing Sheets

GAS TURBINE ENGINE COMPONENT HAVING WAVY COOLING CHANNELS WITH PEDESTALS

BACKGROUND

Gas turbine engines operate by passing a volume of high energy gases through a plurality of stages of vanes and blades, each having an airfoil, in order to drive turbines to produce rotational shaft power. The shaft power is used to drive a compressor to provide compressed air to a combustion process to generate the high energy gases. Additionally, the shaft power is used to drive a generator for producing electricity, or to produce high momentum gases for producing thrust. In order to produce gases having sufficient energy to drive the compressor or generator, it is necessary to combust the fuel at elevated temperatures and to compress the air to elevated pressures, which again increases the temperature. Thus, the vanes and blades are subjected to extremely high temperatures, often times exceeding the melting point of the alloys comprising the airfoils.

In order to maintain gas turbine engine components, such as the airfoils and outer air seals disposed about the tips of the airfoils, at temperatures below their melting point, it is necessary to, among other things, cool the components with a supply of relatively cooler air, typically bleed from the compressor. The cooling air is directed into the component to provide impingement and film cooling. For example, cooling air is passed into the interior of the airfoil to remove heat from the alloy, and subsequently discharged through cooling holes to pass over the outer surface of the airfoil to prevent the hot gases from contacting the vane or blade directly. Various cooling air patterns and systems have been developed to ensure sufficient cooling of various portions of the components.

Typically, each airfoil includes a plurality of interior cooling channels that extend through the airfoil and receive the cooling air. The cooling channels typically extend straight through the airfoil from the inner diameter end to the outer diameter end such that the air passes out of the airfoil. The cooling channels are typically formed by dividers or partitions that extend between the pressure side and suction side. In other embodiments, a serpentine cooling channel extends axially through the airfoil while winding radially back and forth. Cooling holes are placed along the leading edge, trailing edge, pressure side and suction side of the airfoil to direct the interior cooling air out to the exterior surface of the airfoil for film cooling. In blade outer air seals, a similar cooling channel extends between an inner circumferential surface that seals against the blade tips and an outer circumferential surface that contains the cooling air. Holes are typically provided in the inner circumferential surface to bleed cooling air to the tips of the blades.

In order to improve cooling effectiveness, the cooling channels are typically provided with trip strips and pedestals to improve heat transfer from the component to the cooling air. Trip strips, which typically comprise small surface undulations on the airfoil walls, are used to promote local turbulence and increase cooling. Pedestals, which typically comprise cylindrical bodies extending between the channel walls, are used to provide partial blocking of the passageway to control flow. Various shapes, configurations and combinations of partitions, trip strips and pedestals have been used in an effort to increase turbulence and heat transfer from the component to the cooling air.

Sometimes, it is desirable to obtain different heat transfer characteristics at different radial or circumferential positions along the component, particularly in microcircuits comprising narrower channels located between more centrally located channels and the pressure side or suction side of an airfoil. The microcircuits can be further formed by the use of ribs that subdivide the channel into individual circuits. Trip strips can be positioned within the cooling channels to vary the heat transfer, but trip strips are difficult to position within microcircuits. Microcircuits are typically manufactured using a constant thickness sheet of refractory metal, thus fixing the width of the cooling channel. It has been proposed to use microcircuits having cooling channels of constant width that are tapered (decreasing in length between the leading and trailing edges) in the radial direction to decrease cross-sectional area and increase heat transfer properties at the tip of the blade, as is described in U.S. Publication No. 2010/0003142 to Piggush et al., which is assigned to United Technologies Corporation. However, large differences in the heat transfer coefficient are difficult to achieve without the ability to change the Mach number of the coolant fluid, which is typically done with some type of augmentation feature such as trip strips or pedestals. There is a continuing need to improve cooling of turbine components at different radial or circumferential positions of the cooling channels to increase the temperature to which the components can be exposed thereby increasing the overall efficiency of the gas turbine engine.

SUMMARY

The present invention is directed toward a gas turbine engine component having an internal cooling channel for receiving cooling air. The gas turbine engine component comprises a plurality of walls, a cooling channel, a plurality of ribs and a plurality of pedestals. The plurality of walls has a pair of major surfaces opposed to define an interior chamber. The cooling channel extends through the interior chamber of the plurality of walls between the major surfaces. The plurality of ribs extends through the cooling channel to form a plurality of wavy passages having bowed-out sections. The plurality of pedestals is positioned between adjacent ribs, each pedestal being positioned in a bowed-out section.

DETAILED DESCRIPTION

Figure 1:
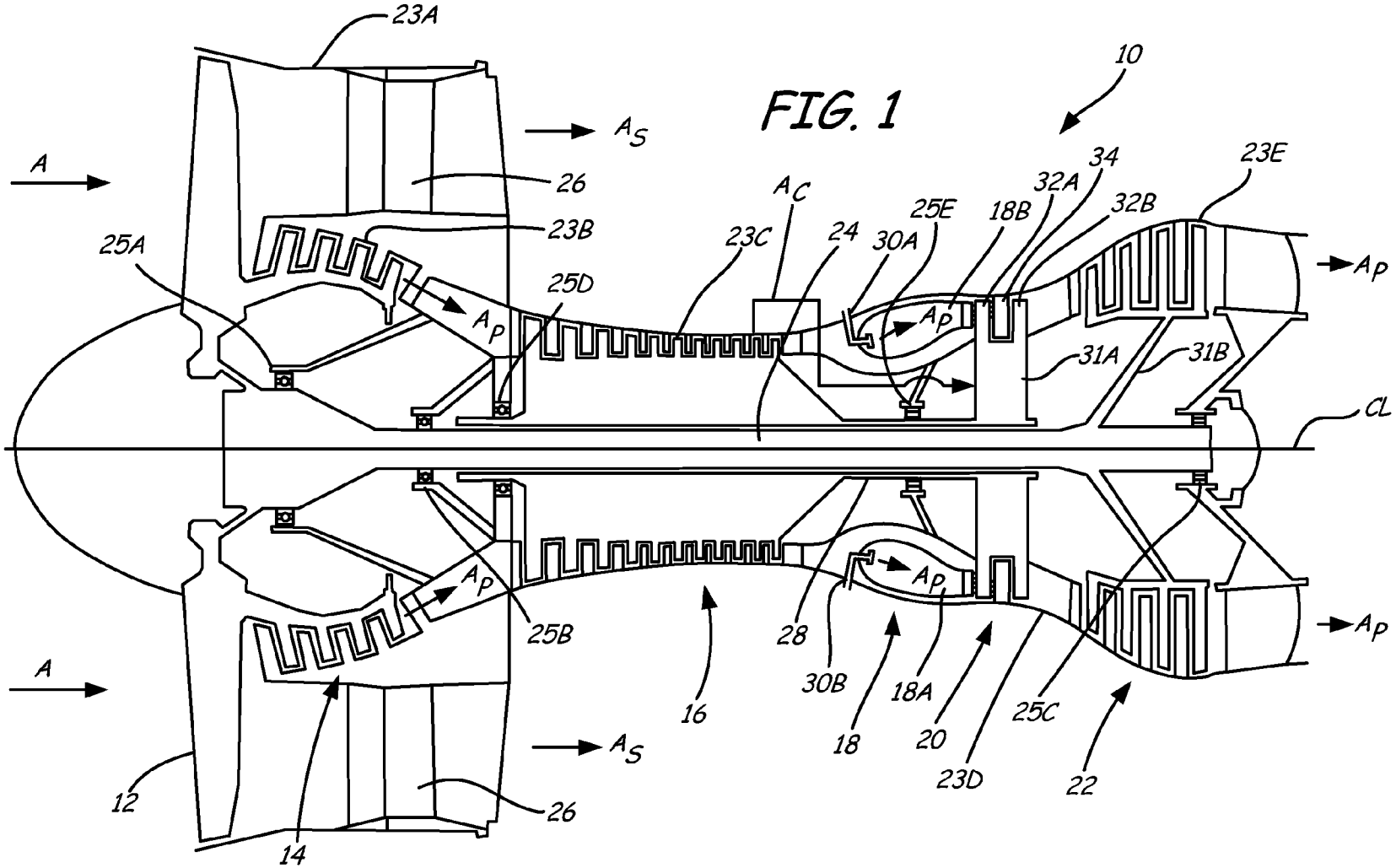
FIG. 1 shows a gas turbine engine including a turbine section in which blades having the cooling channels of the present invention are used.

FIG. 1 shows gas turbine engine 10, in which the wavy cooling channels having pedestals of the present invention may be used. Gas turbine engine 10 comprises a dual-spool turbofan engine having fan 12, low pressure compressor (LPC) 14, high pressure compressor (HPC) 16, combustor section 18, high pressure turbine (HPT) 20 and low pressure turbine (LPT) 22, which are each concentrically disposed around longitudinal engine centerline CL. Fan 12 is enclosed at its outer diameter within fan case 23A. Likewise, the other engine components are correspondingly enclosed at their outer diameters within various engine casings, including LPC case 23B, HPC case 23C, HPT case 23D and LPT case 23E such that an air flow path is formed around centerline CL.

Inlet air A enters engine 10 and it is divided into streams of primary air $A_P$ and secondary air $A_S$ after it passes through fan 12. Fan 12 is rotated by low pressure turbine 22 through shaft 24 to accelerate secondary air $A_S$ (also known as bypass air) through exit guide vanes 26, thereby producing a major portion of the thrust output of engine 10. Shaft 24 is supported within engine 10 at ball bearing 25A, roller bearing 25B and roller bearing 25C. primary air $A_P$ (also known as gas path air) is directed first into low pressure compressor (LPC) 14 and then into high pressure compressor (HPC) 16. LPC 14 and HPC 16 work together to incrementally step up the pressure of primary air $A_P$. HPC 16 is rotated by HPT 20 through shaft 28 to provide compressed air to combustor section 18. Shaft 28 is supported within engine 10 at ball bearing 25D and roller bearing 25E. The compressed air is delivered to combustors 18A and 18B, along with fuel through injectors 30A and 30B, such that a combustion process can be carried out to produce the high energy gases necessary to turn turbines 20 and 22, as is known in the art. Primary air $A_P$ continues through gas turbine engine 10 whereby it is typically passed through an exhaust nozzle to further produce thrust.

HPT 20 and LPT 22 each include a circumferential array of blades extending radially from discs 31A and 31B connected to shafts 28 and 24, respectively. Similarly, HPT 20 and LPT 22 each include a circumferential array of vanes extending radially from HPT case 23D and LPT case 23E, respectively. Specifically, HPT 20 includes blades 32A and 32B and vane 34. Blades 32A and 32B include internal channels or passages into which compressed cooling air $A_C$ air from, for example, HPC 16 is directed to provide cooling relative to the hot combustion gasses. Cooling passages of the present invention include microcircuits having opposing wavy ribs that increase the cross-sectional area of the passages and pedestals positioned between the ribs that produce a net reduction in the cross-sectional area of the passage, thereby improving heat transfer from blades 32A and 32B to the cooling air.

Figure 2:
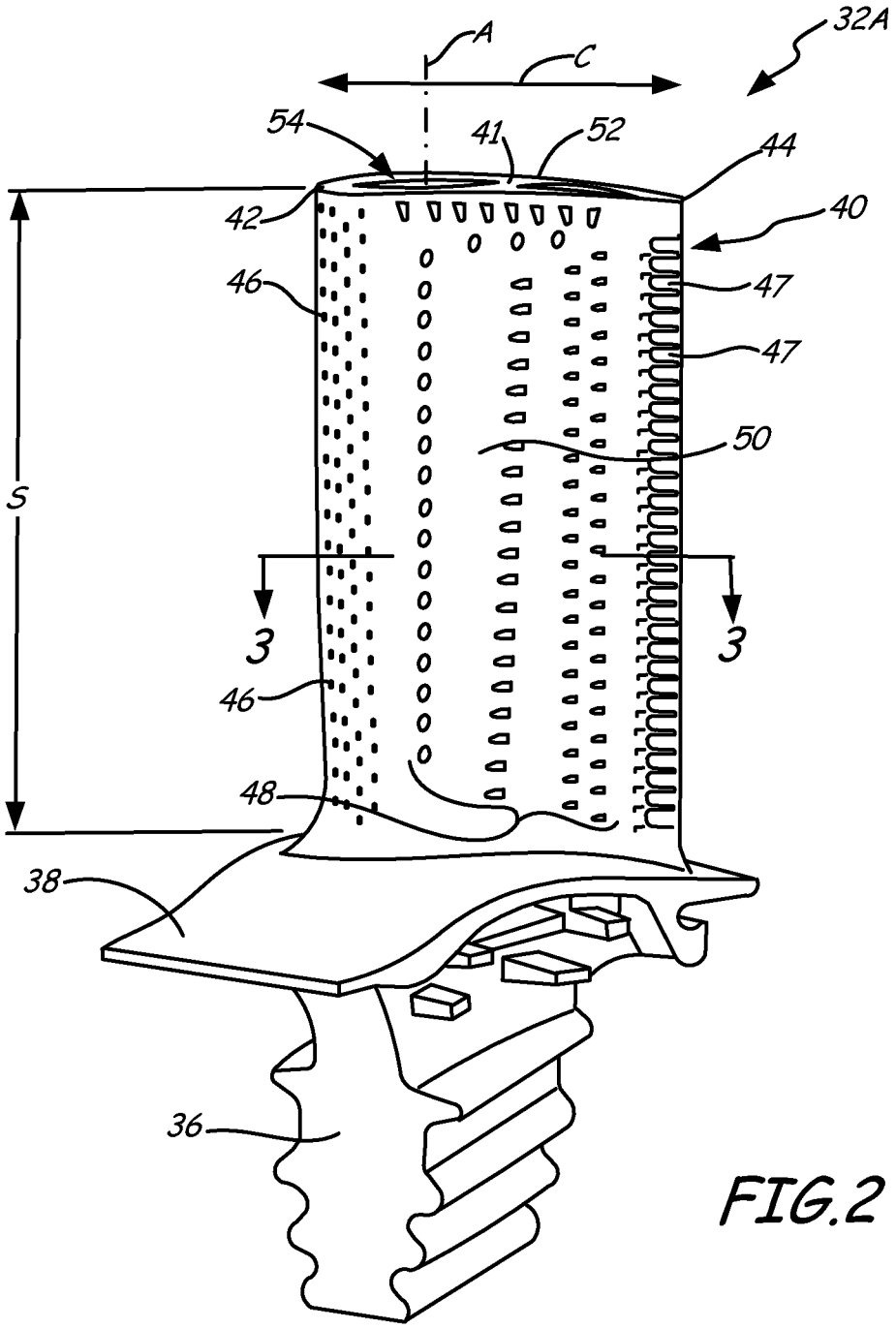
FIG. 2 is a perspective view of a blade used in the turbine section of FIG. 1 having an airfoil through which wavy cooling channels of the present invention extend.
Figure 4:
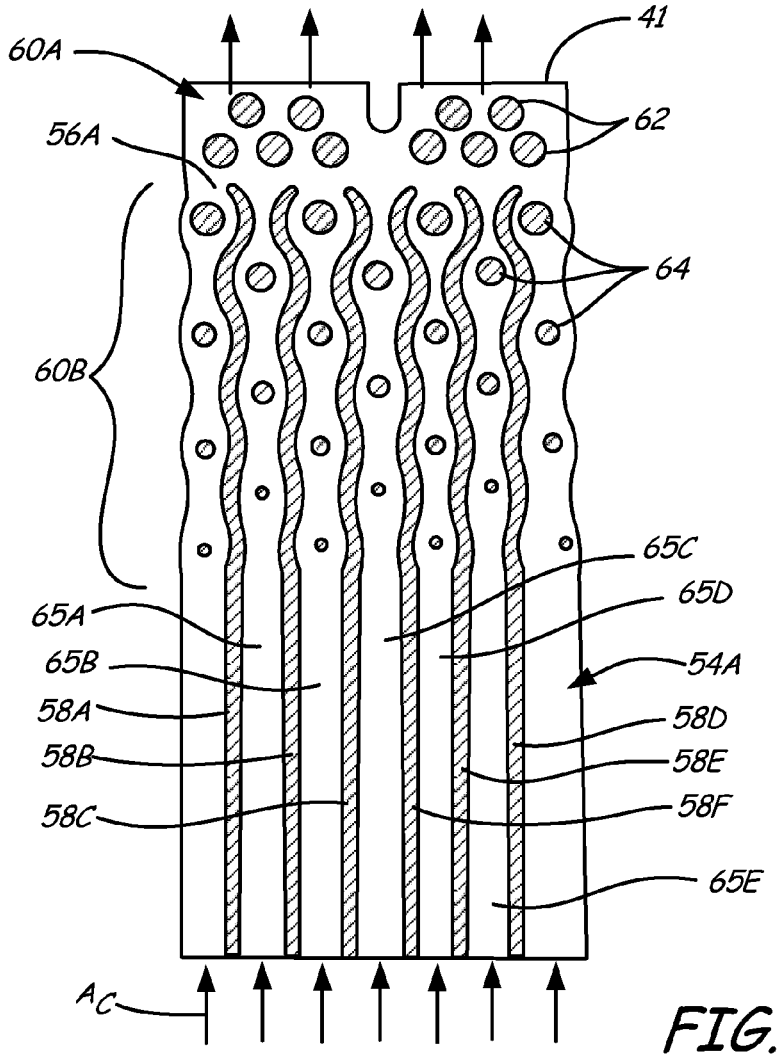
FIG. 4 is a side cross-sectional view of the microcircuit taken at section 4-4 of FIG. 3 showing an arrangement of wavy ribs and pedestals that form the wavy cooling channels.

FIG. 2 is a perspective view of blade 32A of FIG. 1. Blade 32A includes root 36, platform 38 and airfoil 40. Span S of airfoil 40 extends radially from platform 28 along axis A to tip 41. Airfoil 40 extends generally axially along platform 38 from leading edge 42 to trailing edge 44 across chord length C. Root 36 comprises a dovetail or fir tree configuration for engaging disc 31A (FIG. 1). Platform 38 shrouds the outer radial extent of root 36 to separate the gas path of HPT 20 from the interior of engine 10 (FIG. 1). Airfoil 40 extends from platform 38 to engage the gas path. Airfoil 40 includes leading edge cooling holes 46, trailing edge cooling slots 47, pressure side cooling holes 48, pressure side 50 and suction side 52. Although not shown, airfoil 40 may also include various cooling holes along suction side 52. As shown, airfoil 40 includes cooling passages 54 that extend from tip 41 radially down to root 36. Typically, cooling air is directed into the radially inner surface of root 36 from, for example, HPC 16 (FIG. 1). The cooling air is guided out of cooling holes 46, cooling slots 47 and the other cooling holes. As shown in FIG. 4, cooling passages 54 include wavy cooling channels having pedestals of the present invention, which are placed at different radial positions along airfoil 40 to provide different cooling characteristics of cooling air $A_C$ (FIG. 1). As discussed with reference to FIG. 5, the size of the wavy ribs and pedestals can be increased to increase the Mach number and heat transfer coefficient of cooling air $A_C$ (FIG. 1) at the local radial position.

Figure 3:
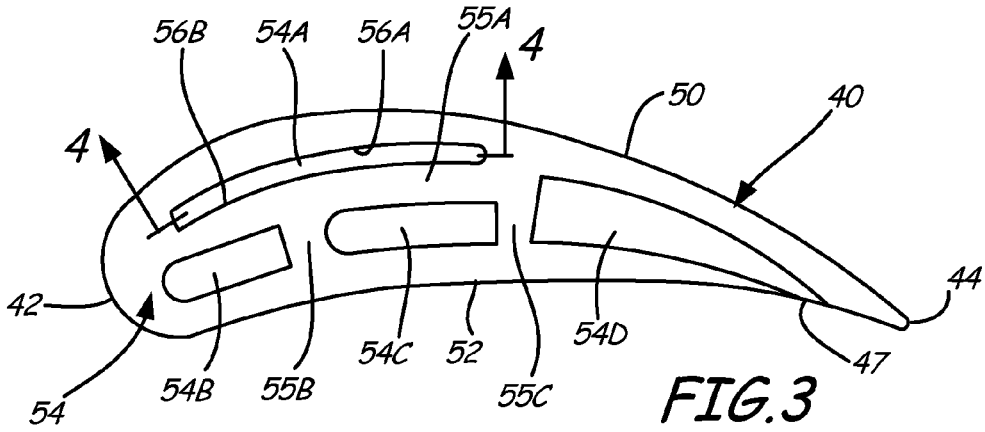
FIG. 3 is a top cross-sectional view of the blade taken at section 3-3 of FIG. 2 showing a suction side microcircuit in which the wavy cooling channels are disposed.

FIG. 3 is a top cross-sectional view of blade 32A taken at section 3-3 of FIG. 2 showing cooling passages 54 extending through airfoil 40. In particular, airfoil 40 comprises a thin-walled structure having a plurality of hollow cavities that form cooling channels 54A-54D. The depiction of cooling holes in airfoil 40 is omitted in FIG. 3. Cooling air $A_C$ (FIG. 1) flows through cooling channels 54A-54D and out the cooling holes to provide cooling to airfoil 40. Cooling channels 54B, 54C and 54D comprise conventional internal cooling channels formed using partitions 55A-55C. Cooling channel 54A comprises a microcircuit cooling channel formed of opposing internal major surfaces 56A and 56B positioned between suction side 50 and internal cooling channels 54B and 54C. Cooling channel 54A is, in one embodiment, manufactured using a constant thickness sheet of refractory metal such that channel 54A has a near constant width between internal surfaces 56A and 56B. As such, the width of cooling channel 54A is in the general circumferential direction extending between suction side 50 and pressure side 52, while its length is in the general axial direction extending between leading edge 42 and trailing edge 44. Cooling channel 54A provides cooling specifically configured for positions along suction side 50. Cooling channel 54A includes wavy ribs disposed between internal surfaces 56A and 56B to form radially extending microcircuits, as shown in FIG. 4.

FIG. 4 is a side cross-sectional view of microcircuit cooling channel 54A taken at section 4-4 of FIG. 3 showing an arrangement of wavy ribs 58A-58F and pedestal groups 60A and 60B in cooling channel 54A. Ribs 58A-58F extend generally radially between an inner diameter portion of airfoil 40 and tip 41 such that cooling air $A_C$ is guided radially through blade 32A. Ribs 58A-58F connect suction side 50 to partition 55A (FIG. 3). Ribs 58A-58F are of the same width in the general circumferential direction, each being uniformly thick across their radial extent such that passage 54A is uniformly thick between surfaces 56A and 56B. Likewise, ribs 58A-58F are of the same length in the general axial direction, each being nearly uniformly thick across their radial extent. Every other rib is identical, with the remaining ribs being mirror images. For example, ribs 58A, 58C and 58E are the same as each other, and ribs 58B, 58D and 58F are the same as each other and are mirror images of ribs 58A, 58C and 58E. Ribs 58A-58F include lower segments that extend generally straight in the radial direction. The straight segments define a nominal cross-sectional area for channels 65A-65E. Ribs 58A-58F include upper segments that extend in the radial direction in an undulating or wavy pattern, as will be discussed in greater detail with respect to FIG. 5.

First pedestal grouping 60A is positioned radially outward of ribs 58A-58F, between the tips of the ribs and blade tip 41. First pedestal grouping 60A includes pedestals 62, which are all of equal shape. In the disclosed embodiment, pedestals 62 are circular and have the same diameter. Pedestals 62 are distributed in a staggered pattern such that cooling air $A_C$ is diffused through grouping 60A to remove heat. Specifically, pedestals 62 connect suction side 50 with partition 55A to pull heat away from suction side 50. Second pedestal grouping 60B includes pedestals 64, and is interposed with the wavy upper segments of ribs 58A-58F. Pedestals 64 also connect suction side 50 with partition 55A to pull heat away from suction side 50. The wavy upper segments of ribs 58A-58F and pedestals 64 are configured to increase the Mach number and the heat transfer coefficient of cooling air $A_C$ as it passes through channels 65A-65E formed between ribs 58A-58F. In other embodiments of the invention, pedestals 62 and 64 need not be round, but can be of other shapes that reduce the net cross-sectional area of channels 65A-65E.

The shape of wavy channels 65A-65E and the size of pedestals 64 are selected to achieve desired Mach numbers and heat transfer coefficients at selected local regions along airfoil 40. For example, a relatively low heat transfer coefficient is desired near where cooling air $A_C$ enters channels 65A-65E. Here, channels 65A-65E are configured as a straight passage with no augmentation features, such as pedestals or trip strips. However, a higher heat transfer coefficient is desired at positions further radial outward of the straight segments. There, a single pedestal 64 is positioned in the center of each channel at a position where ribs 58A-58F form a bowed-out or expanded portion. In alternative embodiments, multiple pedestals are positioned where ribs 58A-58F form bowed-out or expanded portions.

Figure 5:
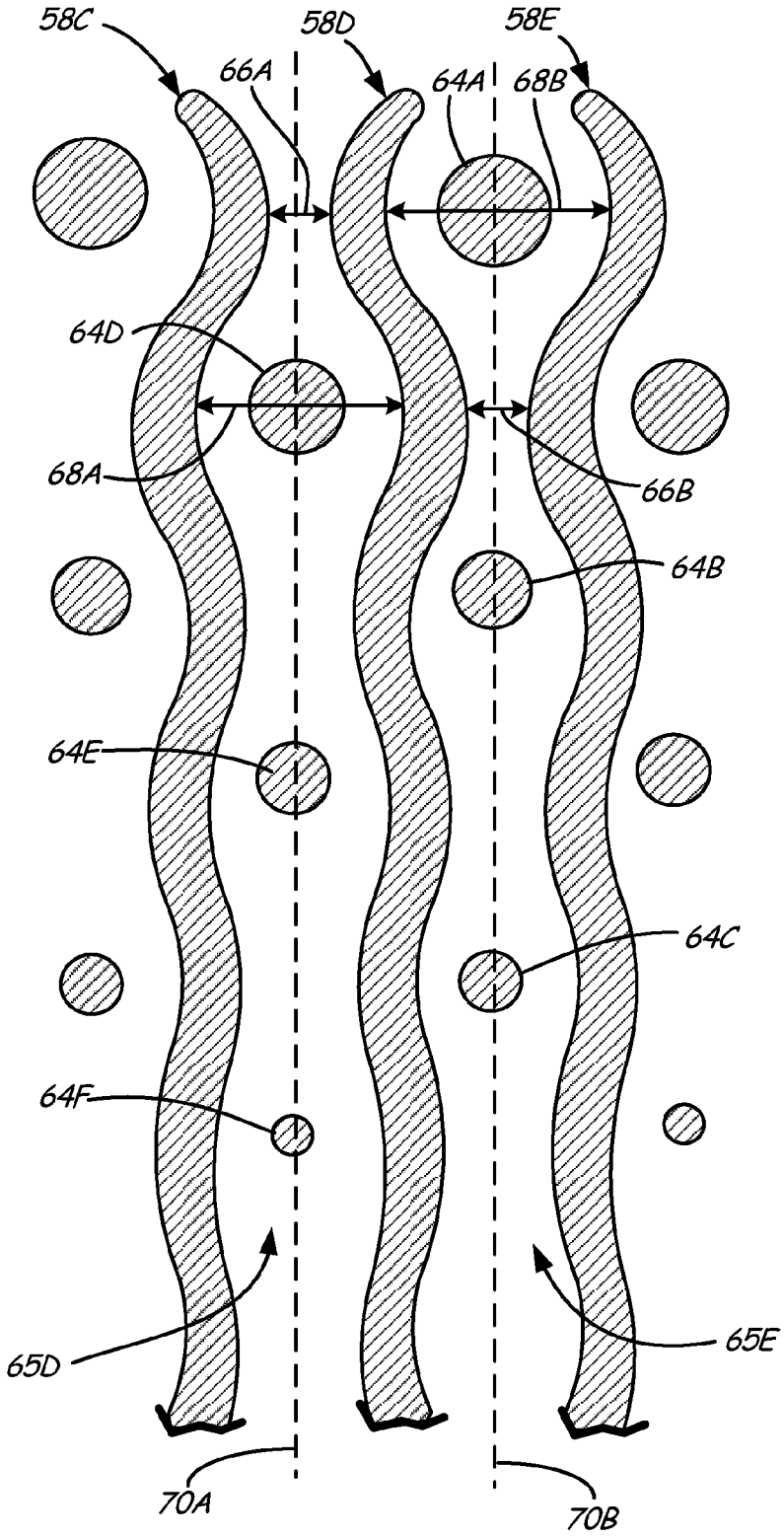
FIG. 5 is a close-up view of the arrangement of FIG. 4 showing pedestals of varying diameter interposed between offset adjacent ribs of varying waviness.

FIG. 5 is a close-up view of the microcircuit cooling channel arrangement of FIG. 4 showing pedestals 64A-64F of varying diameter interposed between offset adjacent ribs 58C-58E of varying wavyness. Ribs 58C-58E form cooling channels 65D and 65E. Ribs 58C-58E include bowed-in sections 66A and 66B and bowed-out sections 68A and 68B. Bowed-out sections 68A and 68B provide an area in which to place pedestals 64D and 64A, respectively. Ribs 58A-58C extend in a radial direction and are spaced from each other in an axial direction, with respect to radial axes 70A and 70B. The lengths of the bowed-out portions of channel 65D and 65E produce bowed-in portions in adjacent channels, in the axial direction. As such, channel 65D includes bowed-in portion 66A and channel 65E includes bowed-in portion 66B. Bowed-in portion 66A is positioned axially upstream of bowed-out portion 68B, while bowed-in portion 66B is positioned axially downstream of bowed-out portion 68A. Thus, bowed-out portions and bowed-in portions give rise to the wavy shape of ribs 58A-58F and channels 65A-65E. Bowed-in sections 66A and 66B comprise constrictions or contractions of channels 65A-65E. Bowed-out sections 68A and 68B comprise expansions of channels 65A-65E. The bowed-out and bowed-in portions also give rise to a staggered distribution of pedestals 64: pedestals in every other column are radially offset from those in axially adjacent columns.

Ribs 58C-58E are bowed so that the addition of pedestals 64A-64F creates only a moderate reduction in the cross section area of the channels, rather than a sudden reduction such as from a pedestal in a straight channel. Ribs 58C-58E curve around pedestals 64A-64F so that the shape of ribs 58C-58F approximate the shape of pedestals 64A-64F. For example, channel 65D includes bowed-out portion 68A having a specific length, while channel 65E includes bowed-out portion 68B having a specific length. Pedestal 64D is positioned centrally within bowed-out portion 68A, and pedestal 64A is positioned centrally within bowed-out portion 68B. Bowed-out portion 68B and pedestal 64A are larger than bowed-out portion 68A and pedestal 64D, respectively. Thus, putting aside the presence of pedestals 64A and 64D, the cross-sectional area of channel 65E is larger than the cross-sectional area of channel 65D at bowed-out portions 68B and 68A. However, because pedestal 64A is larger than pedestal 64D, the net cross-sectional area at bowed-out portion 65A is smaller than at bowed-out portion 68A. In other words, the distance between rib 58D and pedestal 64A at bowed-out portion 68B is less than the distance between rib 58D and pedestal 64D at bowed-out portion 68A. As such, pedestal 64A and bowed-out portion 68B result in a larger Mach number and larger heat transfer coefficient within channel 65E as compared to pedestal 64D and bowed-out portion 68A in channel 65D. In other embodiments, multiple pedestals can be used in place of each of pedestals 64A and 64D. The multiple pedestals can be configured to have the same blockage effect within each of channels 68B and 68A. For example, two smaller pedestals having half the width of pedestal 64A can be positioned in channel 68B. As shown in FIG. 5, the lengths of the bowed-out portions 68A and 68B increase as channels 65D and 65E extend radially outwardly such that additional cooling is provided.

Ribs 58A-58F form an axially extending series of ribs having a radially extending series of bowed-out sections interposed with an array of pedestals that decrease the overall cross-sectional area of channels 65A-65E. This configuration creates flow paths within channels 65A-65E that have cross-sectional areas that decrease relatively uniformly. Specifically, successive bowed-out sections and successive pedestals increase in length and diameter, respectively, in uniform stepped increments in the radial streamwise direction such that cross-sectional areas of the channels are reduced at a constant rate. For comparison, if pedestals are introduced into straight walled channels, there would be significant local reduction in cross section area followed directly by an equal increase in the cross section area, which would result in a non-constant reduction of the Mach number and heat transfer coefficient. Additionally, if only pedestals and no ribs were used to change the desired heat transfer coefficient, sparsely spaced pedestals where low heat transfer is desirable would result in little thermal communication between opposing walls of the channel. Wavy ribs 58A-58F of the present invention allow a significant amount of conduction between surfaces 56A and 56B, thereby reducing thermal gradients between the surfaces. Wavy ribs 58A-58F also produce a strong structural tie between surfaces 56A and 56B that reduces thermally induced stresses. Wavy ribs 58A-58F additionally permit placement of pedestals 64A-64F such that changes in heat transfer coefficient can be achieved while simultaneously changing the Mach number, thereby allowing uniform changes.

The present invention has been described with respect to gas turbine engine airfoils, such as blades and vanes. The invention, however, may also be incorporated into other types of gas turbine engine components that utilize flow or pressurized cooling air $A_C$. For example, air seals located at outer diameter ends of turbine blades utilize cooling air to cool the outer diameter extend of the gas path. These air seals are often referred to as a blade outer air seal (BOAS). As described with reference to FIGS. 6 and 7, wavy cooling channels having pedestals of differing diameters, as configured for the present invention, may be incorporated into blade outer air seals.

Figure 6:
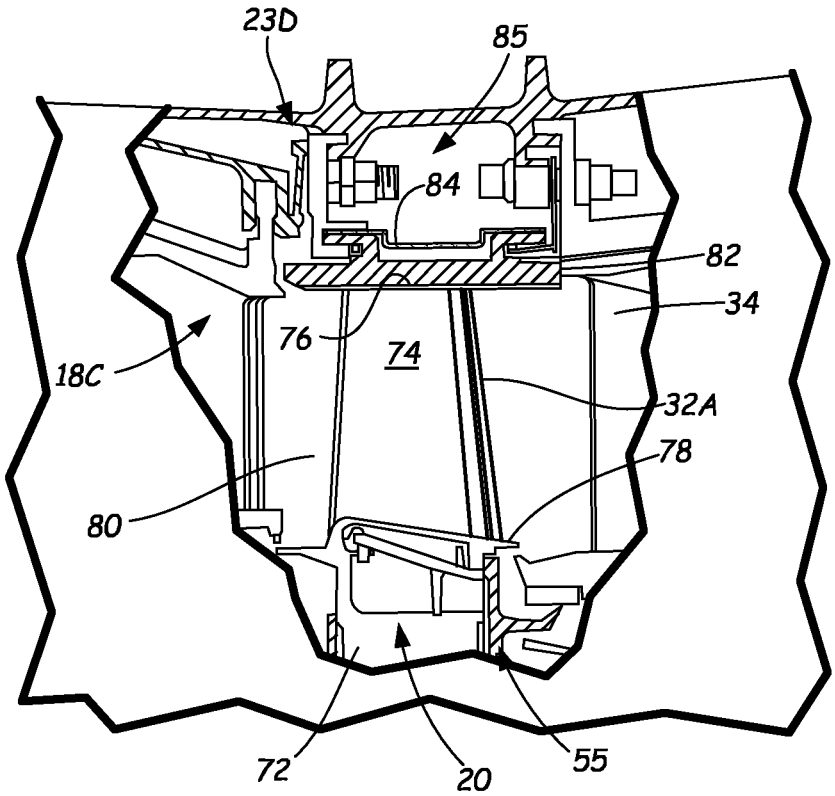
FIG. 6 is a broken away cross-sectional view of the high pressure turbine of FIG. 1 showing a blade outer air seal which incorporates wavy cooling channels of the present invention.

FIG. 6 is a broken away cross-sectional view of high pressure turbine (HPT) 20 of FIG. 1 showing blade outer air seal 82 which incorporates wavy cooling channels of the present invention. HPT 20 is axially positioned between combustor section 18 and vane 34. Disk 31A (FIG. 1) includes rotor blade 32A, which extends radially toward HPT case 23D.

Blade 32A includes root portion 72, airfoil portion 74 having tip 76, and platform 78. Root portion 72 retains blade 32A to disk 31A during rotation of rotor HPT 20. Airfoil portion 74 extends radially outwardly through flow path 80 and provides a flow surface that is acted upon by primary air $A_P$ (FIG. 1). Platform 78 extends laterally from airfoil portion 74 and mates with similar platforms (not shown) of circumferentially adjacent blades to define a radially inner boundary to the flow of combustion gases through HPT 20. HPT case 23D extends circumferentially about and radially outwardly of HPT 20 and includes a plurality of blade outer air seals (BOAS) 82, which comprise a radially outer boundary for the flow of combustion gases through the turbine. Each blade outer air seal 82 includes baffle 84. Each pair of BOAS 82 and baffle 84 comprises a pair of opposing major surfaces that form cooling chamber 92. Cooling air $A_C$ (FIG. 1) is directed between BOAS 82 and baffle 84 to cool the interior surface of HPT case 23D. Wavy cooling channels including pedestals are disposed within cooling chamber 92, as shown in FIG. 7.

Figure 7:
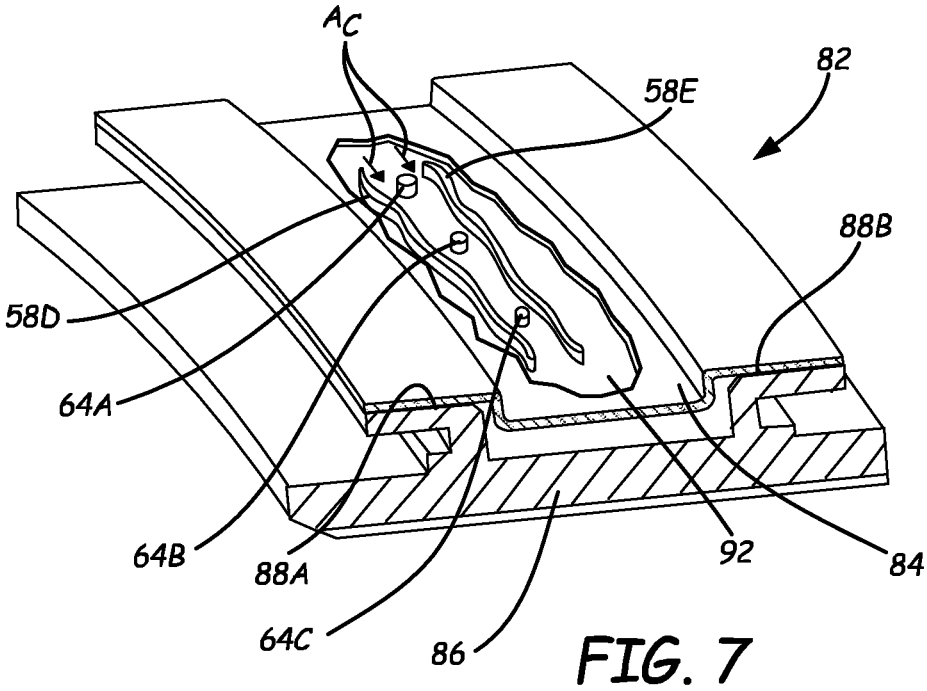
FIG. 7 is a broken away perspective view of the blade outer air seal of FIG. 6 showing pedestals of varying diameter interposed between the wavy cooling channels.

FIG. 7 is a broken away perspective view of blade outer air seal 82 of FIG. 6 showing pedestals 64A-64C of varying diameter interposed between wavy ribs 58D and 58E. Wavy ribs 58D and 58E form cooling channel 65E. Cooling air $A_C$ flows within cooling channel 65E. Configured as such, cooling channel 65E functions similarly to cooling channel 65E of FIGS. 4 and 5, with similar features labeled alike. BOAS 82 includes base 86 and hook portions 88A and 88B. Baffle 84 is positioned over BOAS 82 to form cooling chamber 92.

Base 86 extends circumferentially over tips 76 of airfoil portions 74 (FIG. 6) and may include appropriate abradable material as is known in the art. Hook portions 88A and 88B extend radially from base 86 and include axial projections to engage with mating mounting hardware on HPT case 23D (FIG. 6). Base 86 and hook portions 88A and 88B may include seal slots (not shown) for receiving feather seals to seal between an adjacent BOAS. Base 86 also includes cooling chamber 92, which may be embedded radially inward into base 86. Baffle 84 covers BOAS 82 to retain cooling air $A_C$ within chamber 92. In FIG. 7, baffle 84 is partially broken away to shown ribs 58D and 58E and pedestals 64A-64C.

Ribs 58D and 58E extend radially outwardly from base 86 toward baffle 84. Likewise, pedestals 64A-64C extend radially outwardly from base 86 toward baffle 84. Ribs 58D and 58E are spaced from each other in the axial direction. As shown, cooling air $A_C$ enters cooling channel 65E between ribs 58D and 58E. Ribs 58D and 58E and pedestals 64A-64C need not contact baffle 84, but may do so in various embodiments. In other embodiments, ribs 58D and 58E may extend radially inwardly from baffle 84 toward base 86. In yet another embodiment, baffle 84 may be integrally formed with base 86, such as by a casting process, and ribs 58D and 58E and pedestals 64A-64C may extend from both baffle 84 and base 86. In any embodiment, baffle 84 comprises a cover having a surface that forms the outer radial extent of cooling chamber 92.

The configuration of ribs 58D and 58E and pedestals 64A-64C are selected to achieve desired Mach numbers and heat transfer coefficients at selected regions along base 86. For example, in the embodiment shown, cooling air $A_C$ flows from a first, wider end of channel 65E to a second, narrower end of channel 65E. A low heat transfer coefficient may be desirable where cooling air $A_C$ enters channel 65E. Thus, ribs 58D and 58E are positioned further apart from each other with a small diameter pedestal positioned between. A higher heat transfer coefficient may be desirable where cooling air $A_C$ leaves channel 65E. Thus, ribs 58D and 58E are positioned closer toward each other with a large diameter pedestal positioned between. In another embodiment, cooling air $A_C$ flows from the second, narrower end of channel 65E to the first, wider end of channel 65E, opposite from what is shown in FIG. 7.

Figure 8:
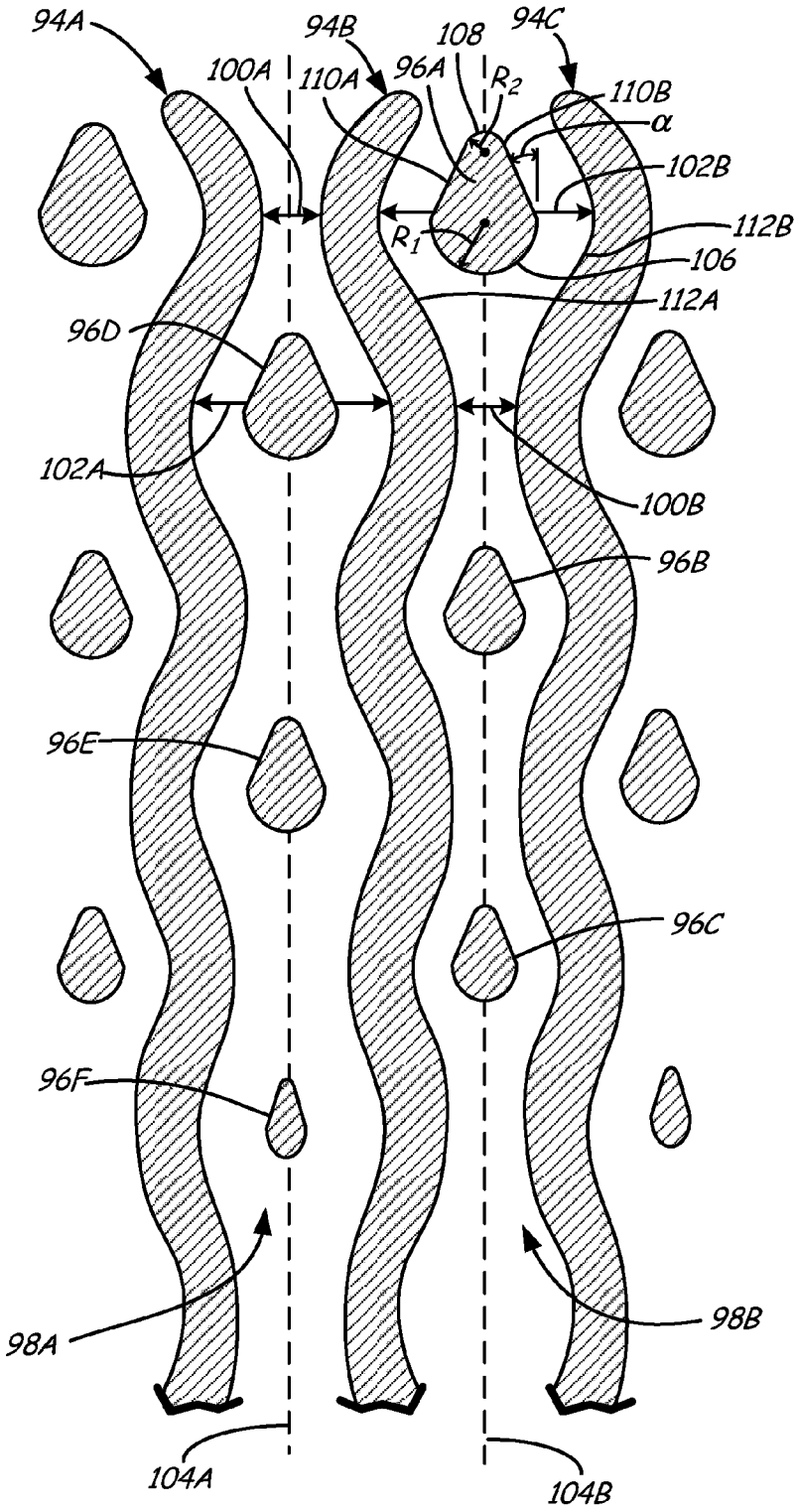
FIG. 8 is a close-up view of another embodiment of the microcircuit taken at section 4-4 of FIG. 3 showing an arrangement of wavy ribs having teardrop shaped pedestals.

FIG. 8 is a close-up view of another embodiment of the microcircuit taken at section 4-4 of FIG. 3 showing an arrangement of wavy ribs 94A-94C having teardrop shaped pedestals 96A-96F. Ribs 94A-94C have varying wavyness to accommodate the shape of teardrop shaped pedestals 96A-96F. Ribs 94A-94C form cooling channels 98A and 98B. Ribs 94A-94C include bowed-in sections 100A and 100B and bowed-out sections 102A and 102B. Bowed-out sections 102A and 102B provide an area in which to place pedestals 96D and 96A, respectively. Ribs 94A-94C extend in a radial direction and are spaced from each other in an axial direction, with respect to radial axes 104A and 104B. Bowed-in sections 100A and 100B and bowed-out sections 102A and 102B give rise to the wavy shape of ribs 94A-94C and channels 98A and 98B. The bowed-out and bowed-in portions also give rise to a staggered distribution of pedestals 96A-96D.

Pedestals 96A-96D are teardrop shaped to assist in eliminating or reducing stagnation zones behind each pedestal within channels 98A and 98B. Stagnation zones detrimentally reduce thermal transfer effectiveness. As depicted in FIG. 8, pedestal 96A includes leading edge wall 106, trailing edge wall 108 and side walls 110A and 110B. Leading edge wall 106 has a first radius of curvature $R_1$ so as to produce a rounded leading edge. Trailing edge wall 108 has a second radius of curvature $R_2$ so as to produce a rounded trailing edge. Radius of curvature $R_2$ is less than the first radius of curvature $R_1$. Side walls 110A and 110B are longer than the distance between side walls 110A and 110B at all points such that pedestal 96A has an elongate shape. Side walls 110A and 110B extend straight between rounded leading edge wall 106 and rounded trailing edge wall 108. In the depicted embodiments pedestal 96A is tapered along the entire length between the leading and trailing edges, but need not be in every embodiment. Side walls 110A and 110B are tangent with the circles of leading edge wall 106 and trailing edge wall 108. As such, side walls 110A and 110B converge toward each other as they extend from leading edge wall 106 to trailing edge wall 108. Pedestal 96A is thus provided with a decreasing height as it extends from its leading edge to its trailing edge. In other words, the distance between side walls 110A and 110B near leading edge 106 is larger than the distance between side walls 110A and 110B near trailing edge 108. In one embodiment, radius of curvature $R_2$ is smaller than radius of curvature $R_1$ such that diffusion angle $\alpha$ is about 5 to about 10 degrees. This diffusion angle $\alpha$ reduces the wake behind pedestal 96, maintaining straight channel flow of the cooling air between ribs 94B and 94C. Diffusion angles $\alpha$ above 10 degrees tend to result in detachment of the cooling air flow as it wraps around the pedestal, similar to that of a round pedestal, thereby resulting in undesirable turbulence dead zones.

As with the embodiment of FIG. 5, ribs 94A-94C are shaped to correspond to the shape of pedestals 96A-96F. Ribs 94A-94C include straightened portions that correspond to the straight sidewalls of each pedestal. For example, ribs 94B and 94C include straight portions 112A and 112B that correspond to sidewalls 110A and 110B of pedestal 96A. Ribs 94A-94C are bowed so that the addition of pedestals 96A-96F creates only a moderate reduction in the cross section area of the channels, rather than a sudden reduction such as from a pedestal in a straight channel. As described above, putting aside the presence of pedestals 96A and 96D, the cross-sectional area of channel 98B is larger than the cross-sectional area of channel 98A at bowed-out portions 102B and 102A. However, because pedestal 96A is larger than pedestal 96D, the net cross-sectional area at bowed-out portion 65A is smaller than at bowed-out portion 68A. In other words, the distance between rib 94B and pedestal 96A at bowed-out portion 102B is less than the distance between rib 94B and pedestal 96D at bowed-out portion 102A. As such, pedestal 96A and bowed-out portion 102B result in a larger Mach number and larger heat transfer coefficient within channel 98B as compared to pedestal 96D and bowed-out portion 102A in channel 98A.

Ribs 94A-94C form an axially extending series of ribs having a radially (as depicted) or circumferentially (such as within a BOAS) extending series of bowed-out sections interposed with an array of pedestals that decrease the overall cross-sectional area of channels 98A-98B. This configuration creates flow paths within channels 98A-98B that have cross-sectional areas that decrease relatively uniformly. Specifically, successive bowed-out sections and successive pedestals increase in length and width, respectively, in uniform stepped increments in the radial or circumferential streamwise direction such that cross-sectional areas of the channels are reduced at a constant rate. Further, in the embodiment of FIG. 8, each pedestal and bowed-out section itself tapers in length and width, respectively, in the radial or circumferential streamwise direction along the axis of the teardrop shaped pedestal. The teardrop shape reduces stagnation zones behind each pedestal.

The present invention permits the local Mach number and heat transfer coefficient to be manipulated to produce moderate or large increases wherever desirable in the airfoil component. For example, in some configurations it is desired to have a quite low heat transfer coefficient in one region of the component and a much higher heat transfer coefficient in another portion of the component. The diameter of the pedestals and the lengths of the bowed-out portions can be varied to adjust these parameters. The wavy ribs and pedestals of the present invention are easily stamped, such is in embodiments where refractory sheet metal of constant width is used to produce microcircuits. As such, the Mach number and heat transfer coefficient can be readily changed within a constant thickness channel.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A gas turbine engine component having an internal cooling channel, the gas turbine engine component comprising:
- a plurality of walls having a pair of major surfaces opposed to define an interior chamber;
- a cooling channel extending through at least a portion of the interior chamber between the major surfaces of the plurality of walls;
- a plurality of ribs extending through the cooling channel to form a plurality of wavy passages having bowed-out sections; and
- a plurality of pedestals positioned between adjacent ribs, each pedestal being positioned in a bowed-out section.

2. The gas turbine engine component of claim 1 wherein each wavy passage comprises:
- a nominal cross-sectional area between adjacent ribs; and
- increased cross-sectional areas at the bowed-out sections;
- wherein the pedestals reduce net cross-sectional area between adjacent ribs to below the nominal cross-sectional area.

3. The gas turbine engine component of claim 1 wherein:
- successive bowed-out sections increase in length between adjacent ribs; and
- pedestals positioned in the successive bowed-out sections increase in size.

4. The gas turbine engine component of claim 3 wherein:
- the bowed-out sections are formed by arcuate portions of the ribs being spaced further apart; and
- the pedestals are round and have increasing diameters along a streamwise direction.

5. The gas turbine engine component of claim 4 wherein successive bowed-out sections and successive pedestals increase in length and diameter, respectively, in uniform stepped increments.

6. The gas turbine engine component of claim 3 wherein:
- the bowed-out sections are formed by straight portions of the ribs being spaced further apart; and
- the pedestals are teardrop shaped and have decreasing widths along a streamwise direction.

7. The gas turbine engine component of claim 1 wherein the plurality of ribs further comprises:
- straight sections positioned near an end of the cooling channel, the straight sections defining the nominal cross-sectional area for each wavy passage.

8. The gas turbine engine component of claim 7 and further comprising:
- a grouping of pedestals located between ends of the plurality of ribs.

9. The gas turbine engine component of claim 1 and further comprising:
- restricted sections defined by each wavy passage;
- wherein the restricted sections of a first wavy passage are located axially adjacent the bowed-out sections of an adjacent wavy passage.

10. The gas turbine engine component of claim 9 wherein the pedestals are arranged in a staggered pattern within the bowed-out sections.

11. The gas turbine engine component of claim 1 wherein the cooling channel has a uniform width between the major surfaces.

12. The gas turbine engine component of claim 1 wherein the pedestals increase a Mach number and a heat transfer rate for cooling air passing through the wavy passages as compared to a nominal cross-sectional area.

13. The gas turbine engine component of claim 1 wherein multiple pedestals are located in each bowed-out section.

14. A turbine airfoil comprising:
- a wall having a leading edge, a trailing edge, a pressure side, a suction side, an outer diameter end and an inner diameter end to define an interior chamber;
- a partition extending radially between the inner diameter end and the outer diameter end of the wall within the interior chamber to define a cooling channel having a width; and
- a pair of opposing wavy ribs extending radially between the wall and the partition to form a cooling circuit having a length, the cooling circuit comprising:
  - a constricted portion having a base cross-sectional area; and
  - an expanded portion having a local cross-sectional area greater than the base cross-sectional area; and a pedestal positioned in the expanded portion to decrease net local cross-sectional area to below that of the base cross-sectional area.

15. The turbine airfoil of claim 14 wherein:

the pair of opposing wavy ribs form a radially extending series of constricted portions and expanded portions, the constricted portions becoming shorter and the expanded portions becoming longer as the series progresses from the inner diameter end to the outer diameter end; and further comprising a series of pedestals positioned in the expanded portions, each successive pedestal becoming larger as the series progresses from the inner diameter end to the outer diameter end.

16. The turbine airfoil of claim 15 wherein:

the expanded portions are formed by arcuate portions of the wavy ribs; and the pedestals are round and are positioned centrally within the expanded portions.

17. The turbine airfoil of claim 14 wherein the ribs further comprise:

straight sections positioned near the inner diameter end of the wall; and a grouping of pedestals located radially between the outer diameter end of the wall and outer diameter ends of the wavy ribs.

18. The turbine airfoil of claim 14 wherein the pedestals are teardrop shaped.

19. The turbine airfoil of claim 14 wherein multiple pedestals are positioned in the expanded portion to decrease net local cross-sectional area to below that of the base cross-sectional area.

20. A blade outer air seal comprising:

a base extending in a circumferential direction;

a cover extending in the circumferential direction spaced radially from the base to form an internal cavity;

a circumferentially extending series of ribs extending radially between the base and the cover to form a plurality of channels, the ribs being undulated to form a sequence of expansions and contractions; and an array of pedestals positioned in the expansions.

21. The blade outer air seal of claim 20:

wherein the plurality of channels have a total cross-sectional area; and wherein the expansions, pedestals and contractions are configured to reduce the total cross-sectional area as the ribs extend in a circumferential direction.

* * * * *